US008109683B2

(12) United States Patent
Holike et al.

(10) Patent No.: US 8,109,683 B2
(45) Date of Patent: Feb. 7, 2012

(54) METHOD AND DEVICE FOR PRINTING ON THE SURFACE OF A STRIP-TYPE MEDIUM

(75) Inventors: Walter Holike, Geislingen (DE); Herbert Mürdter, Albstadt (DE); Albert Gerstenecker, Messstetten (DE)

(73) Assignee: Mettler-Toledo (Albstadt) GmbH, Albstadt (DE)

( * ) Notice: Subject to any disclaimer, the term of this patent is extended or adjusted under 35 U.S.C. 154(b) by 1033 days.

(21) Appl. No.: 11/596,615

(22) PCT Filed: Apr. 7, 2005

(86) PCT No.: PCT/EP2005/003672

§ 371 (c)(1),
(2), (4) Date: Jan. 11, 2008

(87) PCT Pub. No.: WO2005/113342

PCT Pub. Date: Dec. 1, 2005

(65) Prior Publication Data

US 2008/0232893 A1 Sep. 25, 2008

(30) Foreign Application Priority Data

May 17, 2004 (DE) ..... 10 2004 024 340

(51) Int. Cl.
*B41J 15/00* (2006.01)

(52) U.S. Cl. ..... 400/613; 400/621

(58) Field of Classification Search ..... 400/613, 400/611

See application file for complete search history.

(56) References Cited

U.S. PATENT DOCUMENTS

| | | | | |
|---|---|---|---|---|
| 3,707,423 | A | 12/1972 | Davies et al. | |
| 5,001,498 | A * | 3/1991 | Shimizu et al. | 347/215 |
| 5,062,722 | A * | 11/1991 | Shiozaki et al. | 400/582 |
| 5,179,390 | A * | 1/1993 | Yokoyama et al. | 347/215 |
| 5,993,093 | A * | 11/1999 | Schoennauer et al. | 400/621 |
| 6,210,515 | B1 * | 4/2001 | Boreali et al. | 156/250 |
| 6,234,696 | B1 * | 5/2001 | Whittaker | 400/613 |
| 6,343,884 | B1 * | 2/2002 | Watanabe et al. | 400/621 |
| 6,352,381 | B1 * | 3/2002 | Gonmori et al. | 400/615.2 |
| 6,412,992 | B2 * | 7/2002 | Mogi | 400/579 |
| 2004/0101343 | A1 * | 5/2004 | Murdter | 400/615.2 |

FOREIGN PATENT DOCUMENTS

| | | | |
|---|---|---|---|
| DE | 3411817 | A1 | 10/1985 |
| DE | 69602896 | T2 | 12/1999 |
| DE | 69606276 | T2 | 8/2000 |
| DE | 69612392 | T2 | 10/2001 |
| DE | 69709593 | T2 | 8/2002 |
| DE | 10111228 | A1 | 9/2002 |
| DE | 102004024340 | A1 | 12/2005 |
| EP | 0758979 | B1 | 7/1999 |
| EP | 0850841 | A1 | 7/1999 |
| EP | 0758955 | B1 | 11/1999 |
| EP | 1447333 | A1 | 8/2004 |
| JP | 2001-278515 | A | 10/2001 |
| JP | 2002-326615 | A | 11/2002 |

* cited by examiner

*Primary Examiner* — Anthony Nguyen
(74) *Attorney, Agent, or Firm* — Standley Law Group LLP

(57) ABSTRACT

A method and device for improving the handling, in a label printer, of labels without a carrier strip operates by reversing the direction of transport of the label medium for a short distance before transporting the medium in the printing direction, allowing the label strip to reliably detach from a transport roller (10) that is used to guide the label strip through the printer.

19 Claims, 1 Drawing Sheet

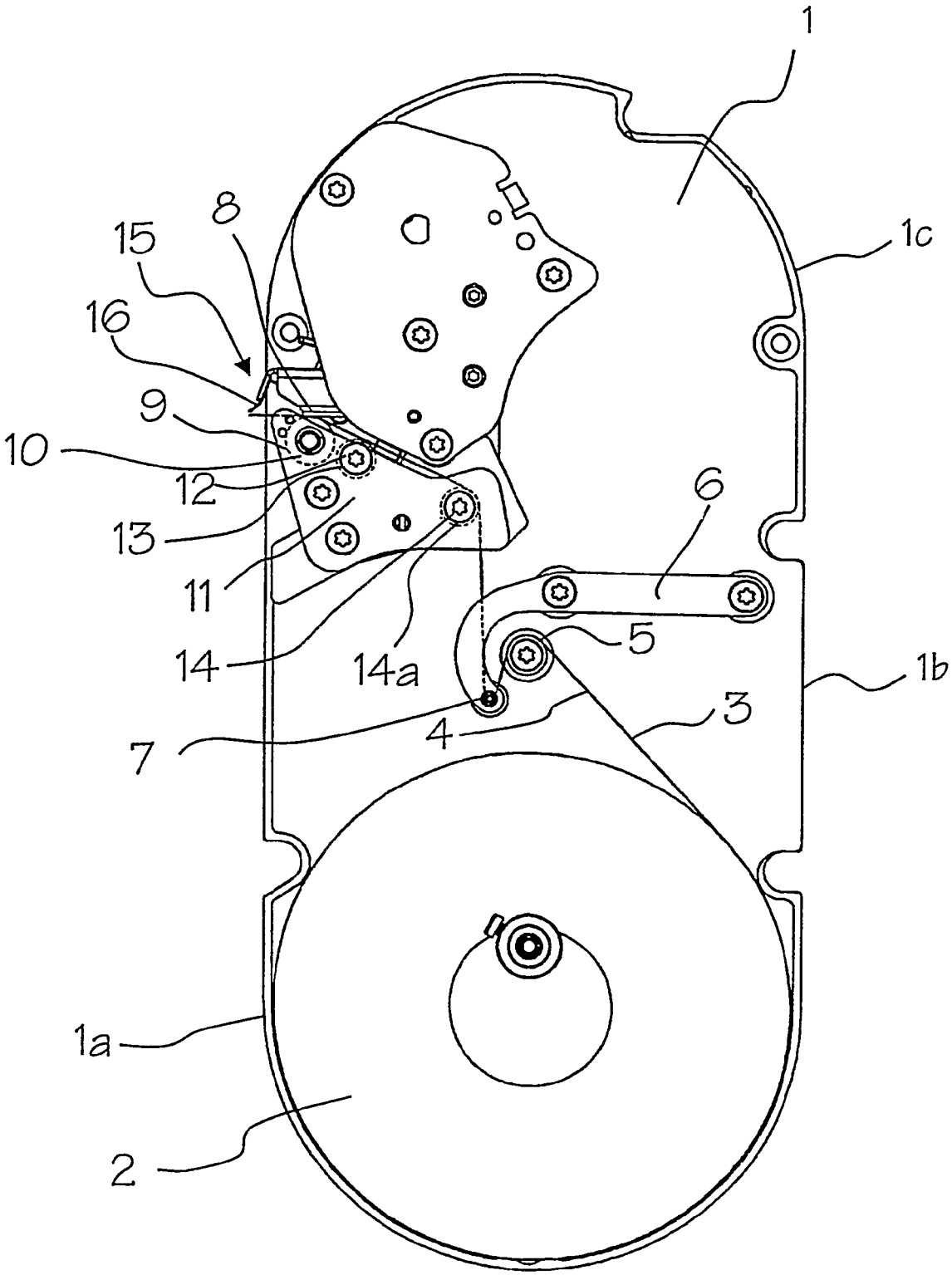
1
1c
8
15
16
9
10
12
13
11
14
14a
6
5
1b
3
4
7
1a
2

METHOD AND DEVICE FOR PRINTING ON THE SURFACE OF A STRIP-TYPE MEDIUM

The invention concerns a method for printing on one surface of a strip-shaped medium, which has a self-adhesive coating on its other surface and during transport intervals is transported in its longitudinal direction from a supply unit, in which a supply of the medium is kept available, through a printing unit, in which the surface of the medium with the self-adhesive coating is guided past a passage gap over a driven transport roller, while the surface of the medium that is to be printed is guided past a print head arranged opposite the transport roller, to a removal point, at which a leading section in the direction of transport is separated from the medium some distance from the passage gap. The invention also concerns a device for carrying out this method.

Methods and devices of the type in question are used especially for producing the printed labels which are affixed to items of merchandise in retail sales establishments. In particular, weight information, such as that originating from a self-service scale, price information, and/or bar codes, i.e., information which is important for the handling of sales transactions, is printed on the surface to be printed. The fact that the surface with the self-adhesive coating is freely exposed as it is being guided through the printing operation offers an advantage over conventional methods, in which the surface with the self-adhesive coating is provided with a liner strip, from which the printed labels must be peeled off before they can be applied. This advantage is that the medium supplied to the printing operation, usually in the form of a roll, takes up less space, and at the same time, the costs associated with the liner strip are also eliminated. However, the handling of the medium with the exposed self-adhesive surface requires special measures during the printing operation to prevent the medium from getting permanently stuck during the printing operation. In particular, the strip-shaped medium, which is usually a paper suitable for thermal printing, has a tendency to follow after, i.e., wrap around, the transport roller with which its surface with the self-adhesive coating is engaged for the purpose of transporting it.

In a well-known method and a well-known device of the aforementioned types (DE 101 11 228 A1), a shape behavior is impressed into the medium, the effect of which is to force the strip-shaped medium into a shape which deflects it away from the transport roller as soon as it emerges from the passage gap formed between the print head and the transport roller. To achieve reliable operation of this device under all circumstances, care must be taken to ensure that the separating effect produced by the natural stiffness and the impressed shape behavior of the strip-shaped medium is always greater than the adhesive effect between the transport roller and the medium emerging from the passage gap. In this regard, it is especially important to consider that the surface of the transport roller wears down with increasing running time, and therefore the adhesion between the surface of the roller and the strip-shaped medium can increase. In addition, after prolonged shutdowns, for example, overnight or on weekends, when the transport of the medium is started up, the medium has a greater tendency to wrap around the transport roller.

In other well-known methods and devices (EP 0 758 979 B1 and EP 0 758 955 B1), this problem is dealt with by providing the transport roller and other surfaces that come into contact with the self-adhesive coating during the printing operation, with an antiadhesive coating. However, this is not sufficient to ensure that the medium can be reliably separated from the transport roller. Therefore, in these well-known methods and devices, an especially important element is a separating blade or a small-diameter separating roller, which is installed downstream of the transport roller in the direction of transport and immediately adjacent to it. The surface of the separating blade or roller is provided with an antiadhesive coating. The strip-shaped medium is thus directed away from the transport roller as it passes over this separating element.

The objective of the invention is to provide a method and a device of the aforementioned types which retain their simplicity and yet have even greater reliability.

The objective with respect to the method is achieved in such a way that, before at least one of the transport intervals, the medium is transported back in the direction opposite the direction of transport over a length that does not exceed the distance from the passage gap.

It was found that the tendency of the strip-shaped medium to adhere to the transport roller in the following transport interval is reduced by transporting it back in the opposite direction from the direction of transport. In this following transport interval, the medium then reliably separates from the transport roller after it has passed through the passage gap and arrives at the removal point, at which a section corresponding to the length of the transport interval and possibly printed with printed data is separated from the strip-shaped medium and can be used, for example, as an adhesive label. Since the section of medium is separated some distance from the passage gap, and the length of the reverse transport does not exceed this distance, the medium remains permanently tensioned in the passage gap between the transport roller and the print head and is thus ready for the next transport interval, in which it is transported by the engagement of the transport roller. In practice, a reverse transport of a few millimeters length is sufficient.

The reverse transport provided for in accordance with the invention is especially effective before the first transport interval that is carried out after a prolonged shutdown. However, in an advantageous embodiment of the method of the invention, the reverse transport in the opposite direction from the direction of transport is carried out before each transport interval. In particular, this increases operating reliability in cases in which the surface of the transport roller has become worn down after a long running time.

For especially good effectiveness of the measure of the invention, it is also advantageous for the reverse transport in the opposite direction from the direction of transport and the transport in the direction of transport be carried out in immediate succession. In this regard, there is no time gap between the reverse transport and the transport in the following transport interval, but rather the two transport operations follow each other in immediate succession.

Furthermore, in accordance with an advantageous embodiment of the invention, it is especially effective if the length by which the medium is transported back in the direction opposite the direction of transport is at least as great as the arc length over which the medium is in contact with the transport roller. During this operation, the reverse transport thus displaces the medium in relation to the transport roller by the whole region in which it was engaged with the transport roller before the reverse transport.

An especially important embodiment of the method of the invention consists in impressing the medium with a shape behavior, which allows the medium to separate from the transport roller. In this embodiment, the method of the present invention is combined with the separation of the medium from the transport roller that is disclosed in DE 101 11 228 A1, so that especially good operating reliability is achieved. In this regard, it is advantageous for the shape behavior to be produced by impressing a curvature into the medium in its longitudinal direction as it is being transported upstream of the transport roller, with the center of curvature being located opposite the surface to be printed.

The basic principle of a device of the invention that is suitable for carrying out the method of the invention is specified in Claim 8. In this regard, in an especially advantageous embodiment, a support element that is positioned opposite the surface of the medium with the self-adhesive coating is installed upstream of the printing unit with respect to the direction of transport. In particular, it is advantageous in this connection for the support element to be a rotatably supported roller.

The support element is installed close to the transport path of the strip-shaped medium in such a way that the strip-shaped medium comes into contact with the support element if the medium cannot separate tangentially from the transport roller during its reverse transport against the direction of transport and thus would deviate from the transport path, which it follows during its transport in the direction of transport, and towards the support element. The support element thus provides an additional safety feature to ensure that the medium leaves the transport roller essentially tangentially during its short reverse transport.

The invention also provides that surface areas of the device that come into contact with the self-adhesive surface of the strip-shaped medium are rendered repellent to adhesives, especially by the application of suitable coatings. This anti-adhesive treatment is intended especially for the cylindrical surface of the transport roller and the cylindrical surface of a support roller that serves as the support element.

Additional features, details and advantages of the invention are revealed by the following description and the sole drawing, wherein the invention is explained and illustrated with reference to a specific embodiment.

The embodiment illustrated in the drawing has a base plate 1, on which all components of the device are mounted. A strip-shaped medium to be printed is coiled in the form of a supply roll 2, which is rotatably mounted in a region 1*a* of the base plate 1 that is located near the bottom in the drawing. The medium consists, for example, of thermal printing paper, which has a surface 4 with a self-adhesive coating and an opposite surface 3, which is to be printed. Media of this type are known in the state of the art as "linerless label web". The supply roll 2 is coiled so that the surface 4 with the self-adhesive coating faces the center of the supply roll 2.

A deflection roller 5 is rotatably supported in a middle region 1*b* of the base plate 1 a certain distance from and coaxially with the supply roll 2. An impressing cylinder 7, which is arranged coaxially with the deflection roller 5 and is set back from the deflection roller 5 towards the supply roll 2, is supported either in a stationary or rotatable way on a bracket 6, which is connected with the base plate 1. A printing unit is located in a region 1*c* of the base plate 1 that is located near the top in the drawing. The printing unit has a bar-shaped thermal print head 8, which lies in a plane perpendicular to the base plate 1 and thus parallel to the axes of the deflection roller 5 and the impressing cylinder 7.

The print head 8 extends tangentially to the cylindrical surface 9 of a transport roller 10, which is rotatably supported opposite the print head 8 on a bearing plate 11 connected with the base plate 1. The transport roller 10 is driven by a drive (not shown in the drawing), which is mounted on the base plate 1 and has gearing and an electric motor. In addition, a deflection roller 14 is rotatably supported on the bearing plate 11 at a point situated between the roller 10 and the impressing cylinder 7. Furthermore, a support roller 12 is rotatably supported on the bearing plate 11 at a point between the transport roller 10 and the deflection roller 14. The cylindrical surface 13 of the support roller 12 comes close to a common tangent to the cylindrical surface 9 of the transport roller 10 and the cylindrical surface 14*a* of the deflection roller 14.

The strip-shaped medium supplied from the supply roll 2 travels from the supply roll 2 to the deflection roller 5, over which the surface 4 with the self-adhesive coating passes, and then proceeds to the impressing cylinder 7, over which the surface 3 to be printed passes. From the impressing cylinder 7, the medium travels to the deflection roller 14, across which the surface 4 with the self-adhesive coating passes. Its self-adhesive surface 4 then passes close to the cylindrical surface 13 of the support roller 12, and the medium then proceeds to the transport roller 10, against which the self-adhesive surface 4 is pressed by the print head 8, which rests on the surface 3 to be printed. As a result of this engagement in the passage gap formed in this way, the rotational motion imparted to the roller 10 by the drive is transmitted to the medium, and as a result the medium is pulled from the supply roll 2 and transported in its longitudinal direction. The transport movement and the actuation of the thermal print head 8 are coordinated with each other by an electronic control unit (not shown) in an already well-known way, so that the print head 8 prints the desired material onto the surface 3 of the medium to be printed as the medium passes through the passage gap between the print head 8 and the transport roller 10. In particular, merchandise identification labels are printed, which are torn off from the strip-shaped medium after it has passed through the device. To assist the tearing off of the label, a tear-off blade 16 facing the surface 13 to be printed is provided at the outlet 15 of the device. This tear-off blade 16 extends over the width of the strip-shaped medium, so that the printed labels can be torn off.

The relative position of the two deflection rollers 5, 14 with respect to the impressing cylinder 7 determines the wrap angle by which the medium passes around the impressing cylinder 7. The radius of the impressing cylinder 7 is relatively small, as a result of which the surface 3 of the medium to be printed is stretched in comparison to its surface 4 with the self-adhesive coating. As a result, a permanent curvature is impressed into the medium in its longitudinal direction, and the center of curvature is opposite the surface 3 to be printed. Although, as it is being transported between the impressing cylinder 7 and the deflection roller 14 and between the deflection roller 14 and the transport roller 10, the medium is straightened out again against this curvature by the tension exerted by the transport roller 10 in the longitudinal direction of the medium, that is, in its direction of transport, the medium reassumes the impressed curvature after it has passed between the transport roller 10 and the thermal print head 8 and has been released from the transport tension. As a result, the medium is separated from the roller 10, since the force with which the impressed curvature is received is sufficient to overcome the adhesive force between the cylindrical surface 9 of the transport roller 10 and the self-adhesive surface 4 of the medium.

In contrast to the arrangement shown in the drawing, in which the deflection roller 5 and the impressing cylinder 7 are a certain distance apart, it is also possible for the deflection roller 5 to be arranged in such a way that, when it is in its operating position, it forms a roller clamping gap with the impressing cylinder 7, through which gap the medium passes. In this case, two axial cylindrical surface lines of the deflection roller 5 and the impressing cylinder 7 lie opposite each other on both sides of the medium and determine the point at which the wrap angle begins. So that the medium can be inserted easily when the roll 2 is replaced, an adjusting device (not shown) can be provided, by means of which the deflection roller and the impressing cylinder can be moved relative to each other into a release position, in which they are positioned a certain distance apart, and the strip-shaped medium can be inserted between them.

In this design, therefore, the opposing cylindrical surface lines of the impressing cylinder 7 and of the deflection roller located upstream with respect to the direction of transport define the point at which the wrap angle begins. Additionally or alternatively, a deflection roller of this type could also be located downstream of the impressing cylinder 7 to define the end of the wrap angle in the same way (not shown).

The jackets of the deflection rollers 5 and 14 and of the transport roller 10, over which the self-adhesive surface 4 of the medium passes, as well as the cylindrical surface 13 of the support roller 12 are designed to be antiadhesive, for example, by the use of suitable coatings.

The arrangement of the medium-transporting roller 10 opposite the print head 8 corresponds to the known state of the art in the field of label printers. For this reason, the transport roller 10 is often referred as the "printing roller". However, it is also conceivable for the medium-transporting roller 10 to be located downstream of the print head 8 with respect to the direction of transport and for a non-driven opposing element to be provided for the print head 8, which element holds the medium against the print head 8 for the printing operation.

If the medium still does not acquire sufficient curvature by being wrapped around the impressing cylinder 7, it is possible to provide a cascade of several impressing cylinders 7, over which the medium successively passes as it is being transported.

In the preceding description, it has been assumed as an example that, in the roll 2, the self-adhesive surface 4 of the medium faces the center of the roll. In this case, as shown in the drawing, the roll 2 turns in the counterclockwise direction as the medium is unwinding. Alternatively, however, the supply roll 2 can be wound in such a way that the surface 3 to be printed faces the center of the roll. In this case, the supply roll 2 is inserted into the device in such a way that it turns in the clockwise direction as it is being unwound. As a result of this type of winding, a pre-curvature is impressed into the medium even while it is on the supply roll 2, and this pre-curvature has the opposite direction of the curvature of the transport roller 10. If suitable materials are chosen, this shape behavior can be sufficient in and of itself to separate the medium from the transport roller 10 without the need for any further impressing. In this case, the impressing device comprising the impressing cylinder 7 and the deflection roller 5 can be completely eliminated, and the medium can be transported directly from the supply roll 2 to the gap between the transport roller 10 and the print head 8.

The drive of the transport roller 10 is actuated by the electronic control unit in such a way, which in itself is already well known, that the transport roller 10, by its engagement with the strip-shaped medium, pulls off lengths of the strip-shaped medium from the supply roll 2 that correspond to the transport intervals and conveys them under the print head 8, over the tear-off blade 16, and out of the device. During this operation, these lengths of the strip-shaped medium are printed with the desired printed material by the print head 8. These printed lengths can be separated by means of the tear-off blade 16 and used, for example, as adhesive labels.

In addition, the control unit has a mechanism that operates as follows: Before the control unit causes the drive to drive the transport roller 10 to carry out a transport interval in the counterclockwise direction, the mechanism in question causes the transport roller 10 to be driven for a short period of time in the opposite direction of rotation, i.e., in the clockwise direction. This causes the medium to be transported back in the opposite direction from the direction of transport. This reverse transport occurs over a length that is smaller than the distance between the tear-off blade 16 and the passage gap between the transport roller 10 and the print head 8, so that the medium remains tensioned in the passage gap even after the reverse transport has been carried out. Due to the adhesion that develops between the self-adhesive surface 4 of the strip-shaped medium and the cylindrical surface 9 of the transport roller 10, it can occur that the strip-shaped medium does not run exactly tangentially to the cylindrical surface 9 but rather is in contact with the cylindrical surface 9 over a short arc length. The reverse transport of the medium occurs over a length that is at least as great as this arc length. If the medium does not automatically detach itself tangentially from the transport roller 10 during this reverse transport movement but rather is carried along slightly in the clockwise direction of rotation of the transport roller 10, the medium is deflected towards the support roller 12, whose cylindrical surface 13 comes close to a common tangent of the transport roller 10 and the deflection roller 14. After only a very short deflection, the medium comes into contact with the cylindrical surface 13 of the support roller 12, which helps the medium become tangentially detached from the transport roller 10. After the reverse transport, the driving direction reverses. This starts the transport interval, as the transport roller 10 is driven counterclockwise and causes a corresponding advance of the medium. The reverse transport and the subsequent resumption of transport in the transport direction can follow each other in immediate succession. However, it is also possible to provide a small time interval between them. Furthermore, the mechanism can be designed in such a way that it carries out the reverse transport before each transport interval. However, it is also possible to carry out the reverse transport only before transport intervals that are preceded by a prolonged shutdown. The mechanism could also be designed in such a way that it causes the reverse transport to be carried out when a predetermined number of transport intervals, which is greater than 1, has been carried out.

LIST OF REFERENCE NUMBERS

1 base plate
1*a* lower region
1*b* middle region
1*c* upper region
2 supply roll
3 surface to be printed
4 surface with a self-adhesive coating
5 deflection roller
6 bracket
7 impressing cylinder
8 print head
9 cylindrical surface
10 transport roller
11 bearing plate
12 support roller
13 cylindrical surface
14 deflection roller
14*a* cylindrical surface
15 outlet
16 tear-off blade

The invention claimed is:

1. A method for printing on a strip-shaped medium having one surface to be printed and a self-adhesive coating on the other surface thereof, the method being performed using a printing device that comprises:

a supply unit for keeping available the strip-shaped medium;

a printing unit comprising:

a driven transport roller to transport the medium and to guide the other surface of the medium during said transport; and a print head arranged opposite to the transport roller, forming a passage gap for the medium therebetween;

a separating device at a removal point where part of the medium is separated, the removal point being located at a given distance from the passage gap; and a support roller, rotatably supported and arranged between the printing unit and the supply unit;

the method comprising the steps of:

transporting the medium, for a given time period defining a transport interval, along a transport path in a longitudinal direction thereof, from the supply unit through the printing unit and the passage gap to the removal point, the transport defining a transport direction and a leading portion of the medium in the transport direction, guiding the surface intended to be printed past the print head and guiding the other surface over the transport roller, detaching the leading portion from the medium at the removal point;

repeating the transporting step for a plurality of transport intervals; and reversing the direction of the medium, for at least one of the plurality of transport intervals, in a reverse transport path in the direction opposite to the transport direction and over a length that does not exceed the distance from the passage gap, such that, if reversing the transport direction does not detach the medium tangentially from the transport roller, then the medium deflects from the transport path towards, and contacts, the support roller, which assists in detaching the medium from the transport roller.

2. Method in accordance with claim 1, wherein the reverse transport in the direction opposite the direction of transport is carried out before each of the plurality of transport intervals.

3. Method in accordance with claim 1, wherein the reverse transport in the direction opposite the transport direction and the transport in the transport direction follow each other in immediate succession.

4. Method in accordance with claim 1, wherein a length over which the medium is in contact with the transport roller during the transport in the transport direction defines an arc length, and the length by which the medium is transported back in the direction opposite the transport direction is at least as great as the arc length.

5. Method in accordance with claim 1, wherein a shape behavior is impressed into the medium, as a result of which the medium separates itself from the transport roller, the shape behavior being a curvature impressed into the medium in the longitudinal direction as the medium is being transported upstream of the transport roller, with a center of curvature being located opposite the surface of the medium to be printed.

6. Method in accordance with claim 5, wherein the surface to be printed is transported over an impressing cylinder of relatively small radius with a wrap angle suitable for the impressing.

7. A device for printing on a strip-shaped medium having a first surface to be printed and a self-adhesive coating on an opposite second surface, the printing device comprising:

a supply unit for keeping available the strip-shaped medium, a printing unit, comprising:

a driven transport roller to transport the medium and to guide the second surface of the medium during the transport; and a print head arranged opposite to the transport roller to form a passage gap for the medium therebetween; and a separating device for separating parts of the medium, located at a given distance from the passage gap; and a support roller, rotatably supported and arranged between the printing unit and the supply unit;

said printing device being controlled to:

transport the medium for a given time period defining a transport interval along a transport path in a longitudinal direction of the medium, from the supply unit through the printing unit and the passage gap to the removal point, the transport defining a transport direction and a leading portion of the medium in the transport direction, wherein the first surface of the medium is guided past the print head, while the second surface is guided over the transport roller;

separating the leading portion from the medium by the separating device;

repeat the transport step and separating step for a plurality of the transport intervals;

reverse the transport of the medium, for at least one of the plurality of transport intervals, back along a reverse transport path in the direction opposite the transport direction over a length that is less than the distance from the passage gap, the support roller being arranged such that, if the medium does not detach tangentially from the transport roller during the reverse transport, then the deflection of the reverse transport path from the transport path brings the second surface into contact with the support roller, assisting in tangential detachment.

8. Device in accordance with claim 7, wherein the length over which the medium is in contact with the transport roller during the transport in the transport direct defines an arc length and the reverse transport has a length as least as long as the arc length.

9. Device in accordance with claim 7, wherein the support element has an antiadhesive coating.

10. Device in accordance with claim 7, comprising an impressing mechanism located upstream of the transport roller with respect to the transport direction, for impressing a curvature that runs in the longitudinal direction of the medium, with the center of curvature being located opposite the first surface.

11. Device in accordance with claim 10, wherein the impressing mechanism has an impressing cylinder with a relatively small radius for impressing the curvature, around which cylinder the first surface is guided with a suitable wrap angle.

12. Device in accordance with claim 11, wherein the impressing cylinder is stationary.

13. Device in accordance with claim 11, wherein the impressing cylinder is mounted so that it rotates about the cylinder axis.

14. Device in accordance with claim 11, wherein a deflection roller for adjusting the wrap angle is provided, over which roller the self-adhesive surface (4) of the medium is guided.

15. Device in accordance with claim 14, wherein the deflection roller is located at a given distance from the impressing cylinder.

16. Device in accordance with claim 7, wherein the medium is supplied from a coiled roll, in which the self-adhesive surface faces the center of the roll.

17. Device in accordance with claim 7, wherein the medium is supplied from a coiled roll, in which the first surface faces the center of the roll.

18. Device in accordance with claim 7, wherein each part of the device which comes into contact with the self-adhesive surface has a surface containing contact areas for effectuating the contact with the self-adhesive surface of the medium, the contact areas having an antiadhesive coating.

19. Device in accordance with claim 7, wherein the device is controlled to carry out the reverse transport in the direction opposite the transport direction before each of the plurality of transport intervals.

* * * * *